United States Patent [19]

Szarka

[11] Patent Number: 4,909,146

[45] **Date of Patent: * Mar. 20, 1990**

[54] DUAL LOCATOR SYSTEM FOR PALLET SUPPORT PLATE

[75] Inventor: Sandor Szarka, Franklin Lakes, N.J.

[73] Assignee: Precision Screen Machines, Inc., Hawthorne, N.J.

[ * ] Notice: The portion of the term of this patent subsequent to Apr. 5, 2005 has been disclaimed.

[21] Appl. No.: 178,417

[22] Filed: Apr. 1, 1988

Related U.S. Application Data

[63] Continuation-in-part of Ser. No. 98,935, Sep. 21, 1987, Pat. No. 4,735,139.

[51] Int. Cl.[4] ..... B41F 15/10; B41F 15/26

[52] U.S. Cl. ..... 101/126

[58] Field of Search ..... 101/126, 115; 198/345

[56] References Cited

U.S. PATENT DOCUMENTS

| | | | |
|---|---|---|---|
| 3,596,704 | 8/1971 | Roe | 198/34 S X |
| 3,795,189 | 3/1974 | Jaffa | 101/126 X |
| 4,099,460 | 7/1978 | Bubley et al. | 101/126 X |
| 4,221,165 | 9/1980 | Ericsson | 101/126 |
| 4,305,331 | 12/1981 | Colapinto | 101/126 X |
| 4,407,195 | 10/1983 | Jaffa | 101/126 X |
| 4,735,139 | 4/1988 | Szarka | 101/126 |

FOREIGN PATENT DOCUMENTS

| | | | |
|---|---|---|---|
| 1208614 | 10/1970 | United Kingdom | 101/126 |

OTHER PUBLICATIONS

"Antec—Screen Printing Equipment Engineered for the Hands", advertising publication, 12 pp. dated 06/21/85.

*Primary Examiner*—Clifford D. Crowder

*Attorney, Agent, or Firm*—Hopgood, Calimafde, Kalil, Blaustein & Judlowe

[57] ABSTRACT

In a screen printing machine, a dual locator system for accurately positioning a pallet support plate and associated printing pallet. In operation the inner and outer edge of the pallet assembly are releasably engaged by said dual locator so as to lock the pallet in a predetermined position relative to the printing screen when the printing machine is in the print portion of the printing cycle.

12 Claims, 4 Drawing Sheets

DUAL LOCATOR SYSTEM FOR PALLET SUPPORT PLATE

This is a continuation-in-part of my copending application Ser. No. 098,935 filed on Sept. 21, 1987. now U.S. Pat. No. 4,735,139.

BACKGROUND OF THE INVENTION

The invention relates generally to screen printing machines and indexes used for the semi-automatic printing of multicolor images.

In particular this invention relates to a pallet assembly in combination with a dual locator system that permits the efficient and accurate registration of a pallet prior to printing.

Modern day screen printing machines and associated indexers are adapted to index the objects to be printed upon between individual print stations for the purpose of receiving multicolor print images. Screen printing apparatuses of this general configuration are disclosed, for example, in U.S. Pat. Nos. Re 29,160, 4,031,825 and my co-pending application Ser. No. 118,429 filed on Nov. 6, 1987, the disclosures of which are hereby incorporated by reference.

In general, screen printing machines of the above-mentioned type are provided with a plurality of pallet support plates that surround and extend from a central drive mechanism. These plates are horizontally positioned on a track having a predetermined geometric configuration in a manner which permits co-planar movement of the support plates about the centrally located drive of the machine. The co-planar movement about the track is accomplished by a mechanical drive linked to the individual support plates by a flexible drive member such as a chain. The drive means, through a suitable indexing mechanism, produces the intermittent motion of the pallets between the various print stations. As would be understood by one skilled in the art, each print station has an associated print head attached to the frame of the printing apparatus so that the print head extends over the travelling plane of the support plates. As would be further understood by those skilled in the art, each print head contains the requisite apparatus for applying a single color print image to the article during the print cycle.

The articles to receive print images are placed onto individual pallets which are in turn fixably attached to the pallet support plates. In operation, the drive mechanism indexes the plates between the spaced print stations. When each plate arrives at its respective print station, its horizontal movement, and in some apparatuses its vertical movement is arrested momentarily. The support plate and associated pallet is then mechanically registered and locked in place and the print cycle begins. Printing is accomplished by pivoting the print head down, or otherwise causing a print screen to contact the surface of the article held by the pallet. A squeegee carriage and flood bar assembly traverse the surface of the screen thereby transferring the image on the screen onto the article. At the termination of the print stroke, the printing screen disengages the screen and squeegee from the work surface; horizontal movement of the pallets then resumes, indexing each pallet to the next print station for further printing.

In a multi-stage printing operation such as those described above, the quality of the print is critically contingent on the positional accuracy of the pallet at each station. If the pallet is permitted to drift from a predetermined reference point, the quality of the print is adversely affected. In the past, attempts have been made to eliminate drift through the introduction of a registration step prior to the print cycle. This registration has been partly accomplished by providing a locking bar or similar device which is actuated to engage the outer edge of the pallet support plate at a single fixed location beneath the printing head. Similarly, registration of the inner edge of the pallet has been attempted by rigidly attaching the support plate to the flexible drive member.

Although the above-described methods of registration have reduced some lateral drift of the pallet, they have not eliminated it completely. Specifically, the registration means employing a single locator to fix the outer edge of the support plate is unable to restrict horizontal drift of the inner edge of the pallet. In this regard, the rigid attachment to the flexible drive member has not been completely satisfactory since the chain, due to is flexibility and tendency to stretch, imparts little, if any, positional control. Moreover, none of the prior art registration means satisfactorily address the problem of pallet drift in the direction transverse to the travel of the pallet, i.e., from front to rear of the printing indexer.

OBJECTS AND SUMMARY OF THE INVENTION

An object of the present invention is to provide a pallet and registration assembly capable of accurately registering a pallet at a fixed and known position beneath a print head and associated print screen prior to printing.

Another object of the present invention is to provide dual locator means and an associated pallet assembly which provides positive and accurate lateral and front to rear positioning of the pallet during the print cycle.

The present invention provides a system which accurately positions the pallet assembly of a screen printing machine at each print station. Accurate registration is accomplished by means of a unique dual locator and floating pallet design that operates to engage and lock distal edges of the pallet support assembly into a predetermined position during the printing cycle.

In one embodiment of the invention, the dual locator means engages the opposite edges of a pallet support means and moves the pallet support means into proper registry in response to the movement of the print head from a non-print position to a print position. In another embodiment of the invention, the dual locator means is moved from its engaged and disengaged position by activation means, the activation of which is in timed sequence in relationship to the printing cycle. In each of the above embodiments, either or both of the individual locator means may be physically associated with the print head or independent therefrom.

Other objects and advantages of the present invention will become apparent from the following description of the preferred embodiment and the associated drawings.

DESCRIPTION OF THE PREFERRED EMBODIMENTS

Figure 1:
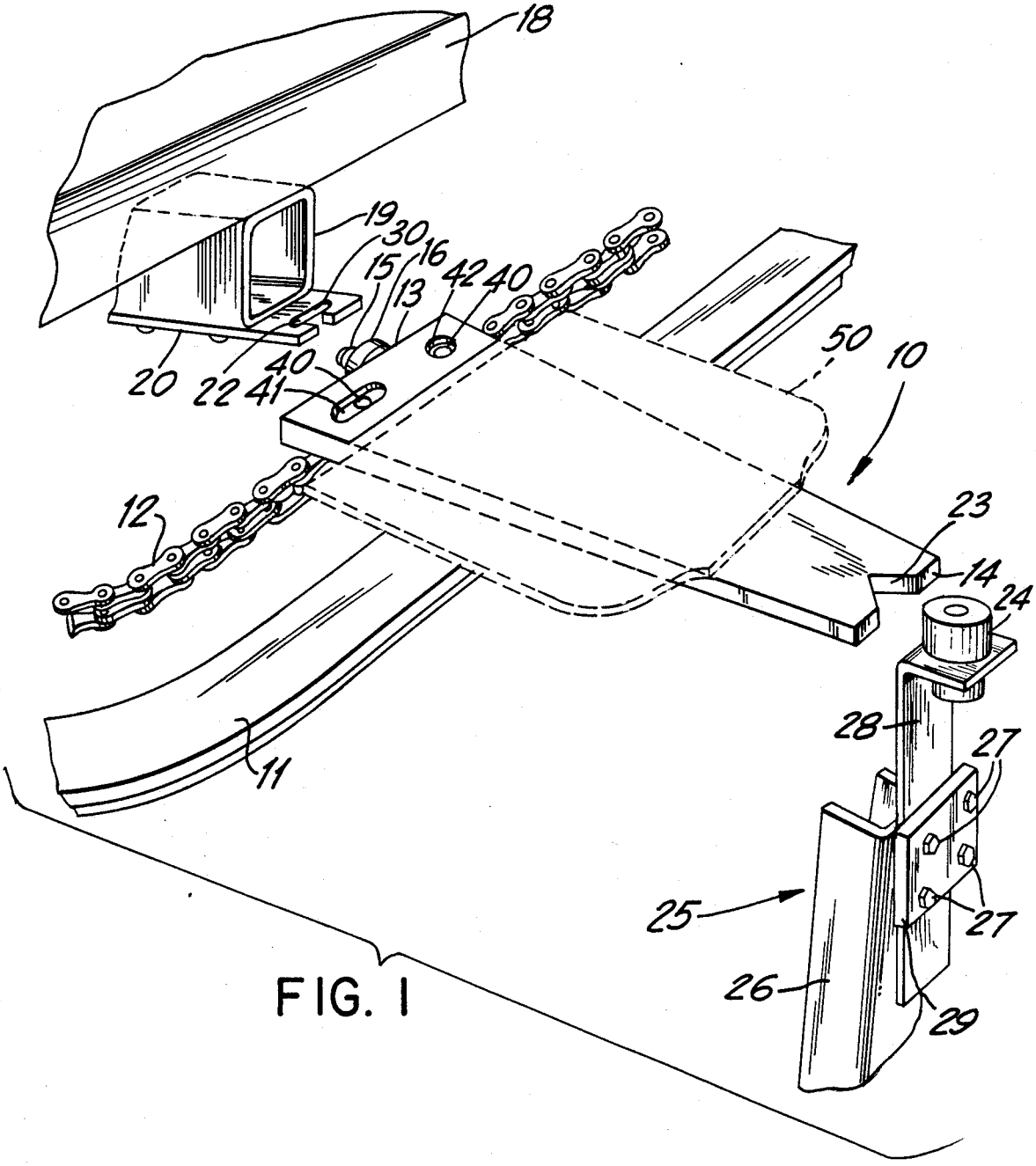
FIG. 1 is a fragmentary perspective view of the dual locator system in accordance with one embodiment of the present invention.

Reference should now be had to the drawings wherein the pallet support plate is designated generally by the reference number 10 throughout the various views. As illustrated in FIG. 1, support plate 10 is a flat and generally triangular structure which is driven by drive chain 12 and travels horizontally on rail 11. More specifically, support plate 10 is attached to drive chain 12 by means of extension pins 40 which extend through bushings 41 and 42 located proximate to the inner edge portion of plate 10.

Figure 2:
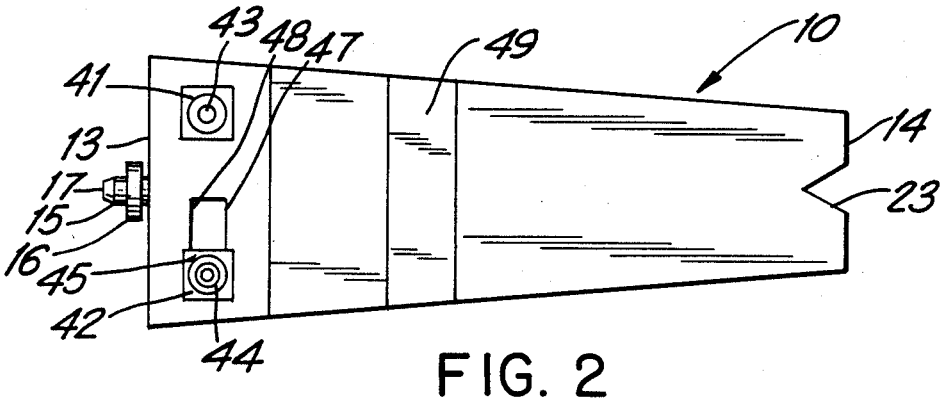
FIG. 2 is a plan view of the underside of the support pallet of the inventive embodiment of FIG. 1.

As can best be seen in FIG. 2, bushings 41 and 42 are surrounded by grommets 43 and 44 respectively. Grommets 43 and 44 may be made of rubber or any other resilient material so as to allow plate 10 some movement relative to pins 40 when an external force is exerted upon the edges of plate 10. As can further be seen from the drawings, bushing 42 and grommet 44 are encased in slider block 45 which is adapted to move parallel to edge 13 of plate 10 within slide rails 47 and 48. The lateral movement of bushing 42 as provided by slider block 45 and rails 47 and 48 compensate for any change in distance between pin 40 when chain 12 travels around the curved sections of the drive chain path, thus preventing binding at those sections. Support plate 10 is also provided on its lower surface with nylon slide pad 49 or a pad of any other suitable material which reduces friction and wear with respect to the upper surface of rail 11.

As will be discussed in greater detail below, the resilient, non-rigid mounting of support plate 10, via grommets 43 and 44 and pad 49, allows the entire support pallet assembly to "float" relative to drive chain 12 and rail 11. It is this floating arrangement in combination with the unique dual locating system of the present invention which allows for the accurate registration of the pallets during the print cycle as contemplated by the present invention. It is noted that although the floating pallet concept of the present invention is described in terms of grommets 43 and 44, and pad 49 it is understood that any means which enables the pallet assembly to "float" as that term is described and used herein in combination with dual locating means is contemplated as being within the scope of the present invention.

Referring again to FIG. 1 support plate 10 is bounded by inner edge 13 and outer edge 14 which are essentially parallel to rail 11. Shaft 15 protrudes horizontally from inner edge 13, and is provided with cam follower 16 which is rotatably mounted on shaft 15 by guide nut 17.

Printing head member 18 represents the inside lower strut of a print head assembly (not shown) which is located in close proximity and extends parallel to inner edge 13 of support plate 10. Spacer bracket 19 is fixably attached to member 18 such that locator bracket 20 is positioned in engageable relationship to cam follower 16 as will be more fully developed below.

Figure 3:
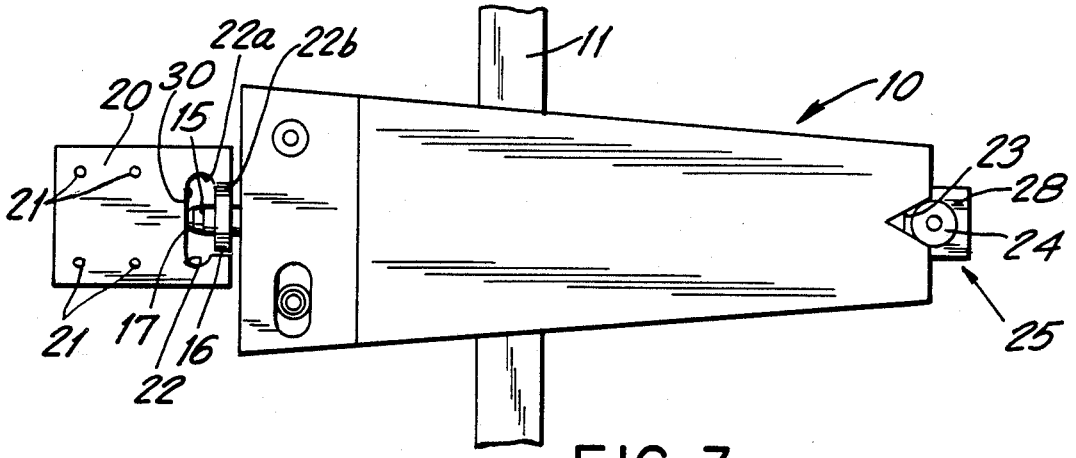
FIG. 3 is a top plan view of the pallet support plate and its engagement with the inner locator bracket and outer locator roller of the inventive embodiment of FIG. 1.
Figure 4:
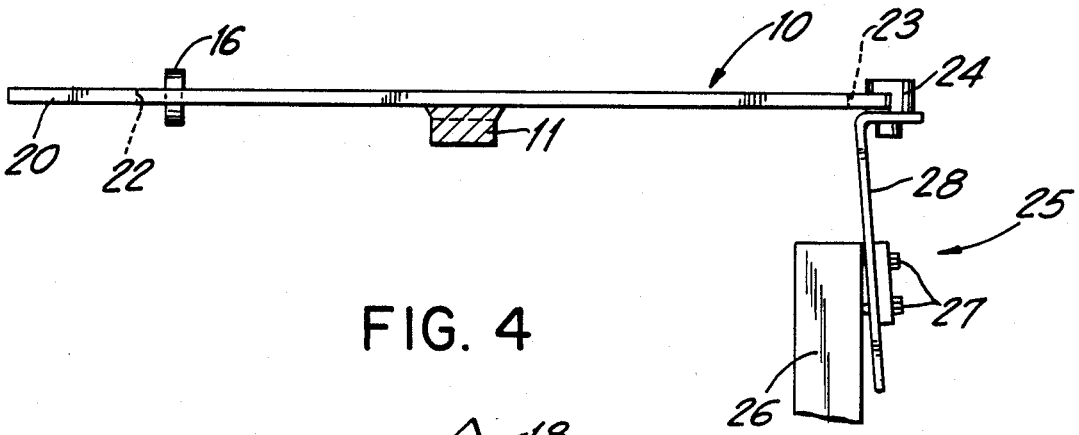
FIG. 4 is a side view of the pallet support plate and its engagement with the inner locator bracket and outer locator roller, of the inventive embodiment of FIG. 1.
Figure 6:
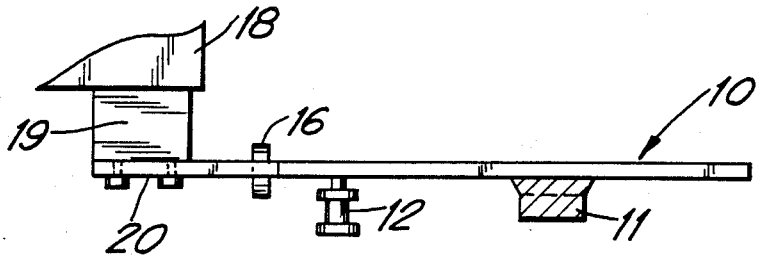
FIG. 6 is a side view of the inner locator system depicted in its engaged and locked position during a print cycle of the inventive embodiment of FIG. 1.

As presented in FIG. 3, locator bracket 20 is a flat rectangular structure with an opening 22 formed on one edge thereof. Opening 22 is in the form of a narrow section, **22*a*, adjacent to the inner side edge and a wider internal section, 22*b*. The dimension of narrow section 22*a* of opening 22 is determined by the outer diameter of cam follower 16 such that opening 22 will fit snugly around roller 16 when the printing head is in its down and print position. (FIGS. 4 and 6**).

As stated above, the size of opening 22 is selected to insure positive engagement between the narrower section, **22*a*, and roller 16. Similarly, the depth of opening 22 is sized such that inner edge 30 of opening 22 contacts guide nut 17 so as to position support plate 10 in a predetermined position transverse to the lateral movement of the support plate when the print head is in its lowered print position. Locator bracket 20 is also provided with four mounting holes 21, which permit attachment by bolts or similar means to spacer bracket 19**, although it is clear that other forms of attachment may be equally suitable and substituted therefor.

Figure 5:
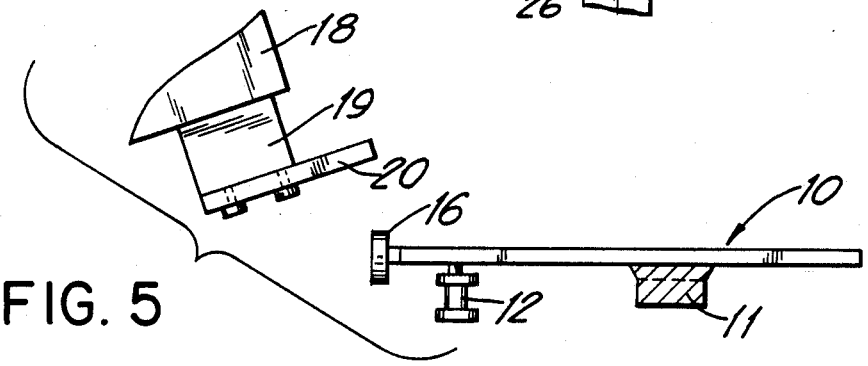
FIG. 5 is a side view of the inner locator system depicted in its disengaged position during a non-print cycle of the inventive embodiment of FIG. 1.

Through its connection to the print head member 18, locator bracket 20 moves in conjunction with the up and down pivoting motion of the print head during operation. More particularly, as the print head pivots downwardly into its print position, inner locator bracket 20 is pivoted from an inclined location above cam follower 16, shown in FIG. 5, to the generally horizontal print position shown in FIG. 6. In the print position, opening 22 engages both the inner cam follower 16 and guide nut 17 thereby preventing lateral movement as well as movement from front to rear of the entire pallet assembly during the print cycle.

In addition to the inner locator means discussed above, the present invention further contemplates an associated outer edge locator means which cooperates with the inner locator system to register the pallet assembly to its predetermined position during the print cycle. Specifically, locator notch 23 is provided on the outer edge 14 of support plate 10. Locator notch 23 is generally V-shaped and is adopted to selectively engage and disengage roller 24 which is, in turn, connected to and positioned by roller support assembly 25. Roller assembly 25 (see FIGS. 1, 3 and 4) is adapted to engage and disengage notch 23 in response to the movement of the printing head from its non-printing position to its print position. The relative vertical positioning of outer roller 24 is adjustable in relationship to member 26 and notch 23 by loosening attachment bolts 27 thus freeing roller support bar 28 from frictional engagement with member 26 and plate 29. It is noted that outer locator assembly 25 functions not only to laterally locate the outer edge of support plate 10 but also functions to bias support plate 10 and guide nut 17 rearwardly against inner edge 30 of locator plate 20 thereby positioning support plate 10 in its predetermined position transverse to the lateral movement of the pallets. Accordingly, although support bar 28 may be made of any suitable material, it has been found that spring steel is most suitable since in its engaged position it helps bias support plate 10 rearwardly.

In operation, the article to be printed upon is placed onto pallet 50 shown by dotted lines in FIG. 1. Pallet 50 is fixably attached (by any number of well known means) to pallet support plate 10, so as to expose the surface of the garment to be printed upon. The pallet support plate is then indexed by the chain drive system to a first print station. Once located, the horizontal motion of the pallet is arrested momentarily and the printing head is pivoted downwardly to its print position. Since inner locator bracket 20 is directly attached to the printing head by spacer 19, locator bracket 20 moves downwardly so as to engage inner cam follower 16 and guide nut 17 located on the inner edge of support plate 10 thereby laterally positioning and locking the inner edge 13 of support plate 10 in its predetermined print position for that individual print station.

If the pallet and support late assembly is laterally misaligned from its predetermined print position prior to engagement with locator 20, the chamfered side walls of opening 22*a* will force follower 16, and the associated pallet assembly, to its predetermined print position. The free spin of cam follower 16 prevents the articulated force exerted upon locator bracket 20 from becoming a scraping action that might otherwise cause undue wear and erosion to bracket 20 and follower 16. Once so positioned, the snug fit between bracket 20 and cam follower 16 ensures that the inner edge of the pallet support plate 10 retains its lateral position throughout the entire printing stroke.

Simultaneously with actuation of the inner pallet locator system discussed above, the outer edge 14 of support plate 10 is also located and locked in a predetermined position under the printing head. Specifically, after support plate 10 is indexed to an appropriate print station and the print cycle is initiated, a mechanical linkage (not shown) articulates machine member 26 towards outer edge 14 of support plate 10 causing roller 24 to engage notch 23 in pallet support plate 10 (FIGS. 3 and 4). The engagement of roller 24 with notch 23 acts to locate the pallet support plate to its predetermined location at the print station. If outer edge 14 of the support plate is slightly out of its proper lateral position, engagement of roller 24 into notch 23 will act to laterally shift support plate 10 into its proper, pre-determined location. Again, the free spin of roller 24 permits this engagement to occur with a minimum of friction thereby enhancing the life of the associated parts.

Further the inner and outer locator means cooperate to further position support plate 10 in its predetermined position transverse to the lateral movement of the pallets. Specifically, when the outer roller assembly engages notch 23 in support plate 10, it simultaneously biases support plate 10 and associated guide nut 17 rearwardly against wall 30 of opening 22 thereby positioning support plate 10 and its associated pallet in its predetermined position transverse to the lateral movement of the pallets. In this regard, it is the resilient, non-rigid mounting (i.e. floating) of pallet support plate 10 in combination with the above-described locator system which allows for the correction of any misalignment of each pallet at the individual print stations thereby providing accurate registration and locking of each pallet in its proper predetermined position prior to printing.

As contemplated by the present invention, each print station is similarly equipped with the dual locator system described, thereby rendering a more accurately placed print image. Multicolor images are created with a minimum of drift related distortion.

Figure 7:
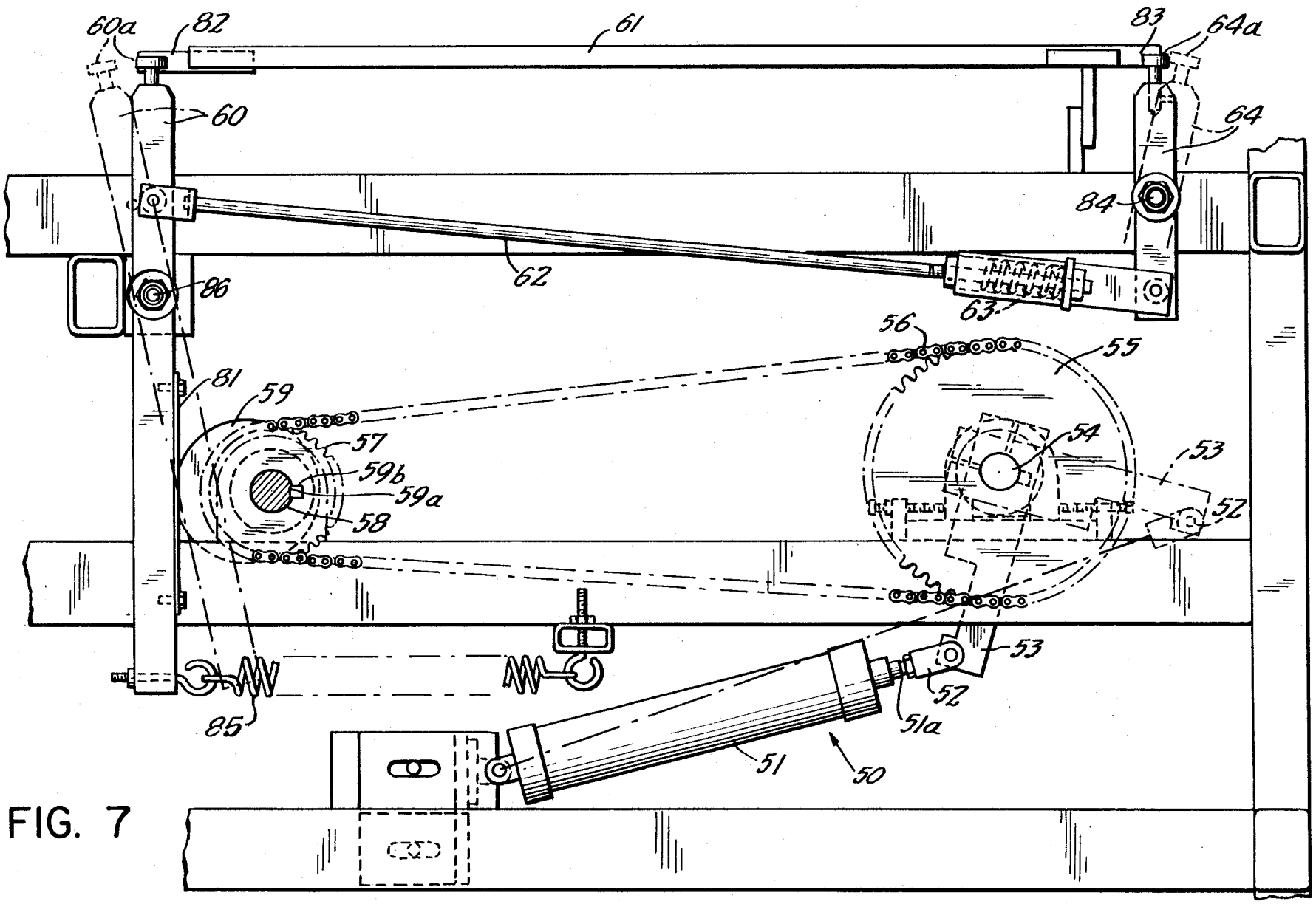
FIG. 7 is a side view of a second embodiment of the dual locator means of the present invention depicting said dual locator means in both the engaged and disengaged position (broken lines)
Figure 8:
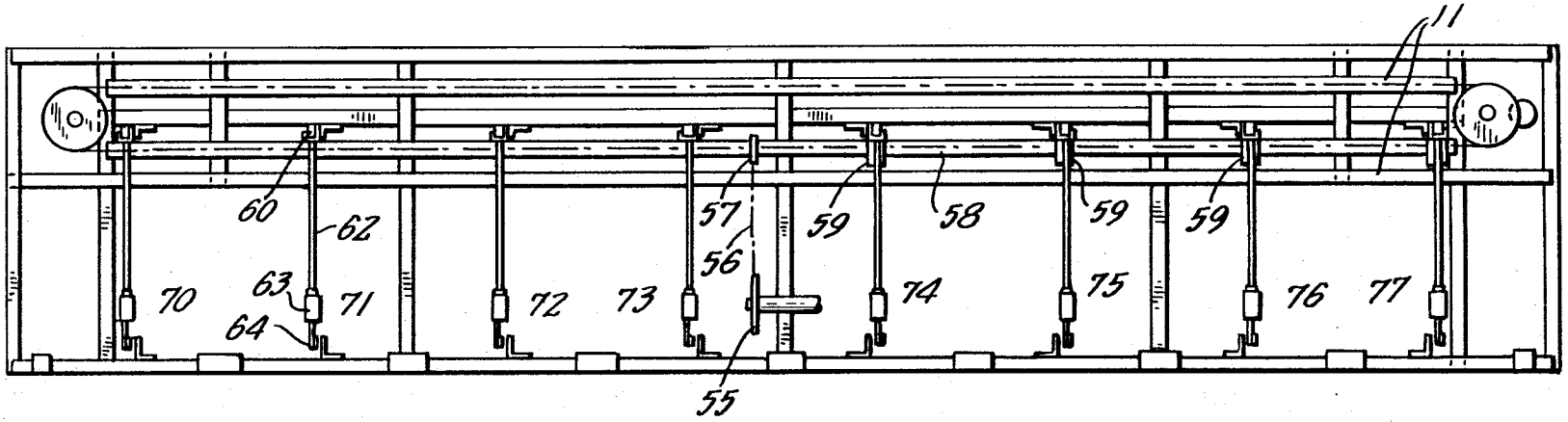
FIG. 8 is a top plan view of a plurality of work stations with the pallet and support means removed and depicting the dual locator system shown in FIG. 7.
Figure 9:
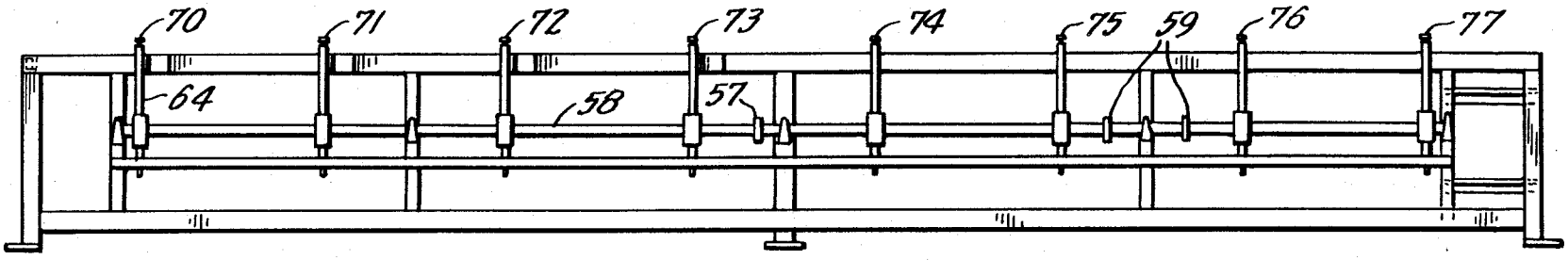
FIG. 9 is a front view of the plurality of work stations shown in FIG. 8.

FIGS. 7–9 depict a further embodiment of the invention wherein the dual locator system is independent of the print head. In this embodiment movement of the dual locator from its engaged to its disengaged position is controlled by an activation means which activates said dual locator in timed sequence in relation to the printing cycle. Although this embodiment of the dual locator system contemplated by the present invention is particularly useful in conjunction with those printing apparatuses having stationary printing heads it may also be utilized in connection with apparatuses having movable printing heads as previously discussed. Indeed, as would be understood by one skilled in the art, the manner in which the dual locator is activated may vary depending on the design of the apparatus to which it is being adapted to while still remaining within the scope of the presently contemplated invention. Moreover, each one of said locator means may be activated individually (FIGS. 1–6) or in tandem as shown in FIGS. 7–9 and described in detail below.

Referring to FIG. 7, activation means 50, comprises cylinder 51 and piston rod 51*a*. Movement of rod 51*a* within cylinder 52 from its retracted position, to an extended position (shown in broken lines) is accomplished through a change in fluid pressure within cylinder 51. The change in fluid pressure is timed in relation to the printing cycle by any well known timing means. Piston rod 51*a* is attached via clevis link 52 to control arm 53 which is fixably attached to shaft 54.

Also fixably attached to shaft 54 is drive gear 55 which cooperates with chain 56 and sprocket 57 to rotate shaft 58 and cam 59 in response to the reciprocating movement of piston rod 51*a*. Sprocket 57, cam 59 and drive gear 55 are fixably attached to shafts 54 and 58 by any well known method as, for example, key 59 and keyway 59*a* as shown.

Cam 59 cooperates with cam follower plate 81 mounted on roller support arm 60 to move said arm and associated locator roller 60*a* between the engaged and disengaged position (shown in broken lines) with locator notch 82 located on pallet support 61. In this regard, the pallet support plate may be of similar construction as that shown in FIG. 1 with the exception that roller 16 is replaced with a "V"-shaped notch adapted to engage roller 60*a*.

Roller support arm 60 is biased against cam 59 by spring 85. As can be seen in the drawings, the reciprocating movement of support arm 60 is transmitted through connecting rod 62 and compressible link 63 to roller support arm 64 and associated locator roller 64*a*. Roller support arm 64 is pivotably mounted on pivot 84 so as to provide movement of roller 64*a* into and out of engagement with locator notch 83 on support 61.

Referring to FIGS. 8 and 9, a printing apparatus adapted with the dual locator means of the present invention is depicted. Specifically, the article to be printed upon and its pallet support assembly (not shown), moves sequentially around rails 11 through a series of work stations designated generally by reference numbers 70 through 77.

As can be seen, shaft 58 extends the entire length of work stations 70–77 and the rotation of which is controlled by cooperating sprocket 57, chain 56 and drive gear 55 as previously described. Fixably secured to shaft 58 at each work station are cams 59 which, as previously described, are adapted to move their respective support arm 60 into and out of locking engagement with pallet support plates 61.

In operation, the internal fluid pressure of cylinder 51 is increased subsequent to the pallet being moved to its position under the printing mechanism, causing piston rod 51*a* to move to its extended position.

The extension of rod 52 causes lever arm 53 to rotate shaft 54 and associated drive gear 55 in a counter-clockwise direction. Similarily, sprocket 57, shaft 58 and cam 59 are rotated by chain 56 in a counter-clockwise direction such that cam 59 rotates roller support arm 60 around pivot 86 causing locator roller 60*a* to engage locator notch 82 on pallet support assembly 61. Similarily, connecting rod 62 pivots locator arm 64 and associated locator roller 64*a* in a counter-clockwise position so that the locator means engages locator notch 83 of pallet support assembly 61, thereby securing said pallet assembly in its predetermined registration with the print screen.

It should be noted that compression link 63 functions to take up any misadjustment that may exist between locator arms 60 and 64 thereby assuring positive locking pressure upon the pallet assembly. Although movement of the two locator arms are shown to move in tandem by means of connecting rod 62, it is understood that the movement of these arms may be accomplished through individual linkages and/or individual activation means. Further, although activation means 50 is depicted as a cylinder and associated piston rod, any activation means responsive to the timing of the printing cycle may be used.

Having described the preferred embodiments of the subject invention it will be appreciated by those skilled in the art that various changes can be effected without departing from the spirit of the invention.

What is claimed is:

1. A dual locator pallet assembly for use in a printing machine having associated therewith a printing screen comprising: a resiliently mounted printing pallet assembly, said pallet assembly having at least one pair of opposite edges; dual locator means, each one of said dual locator means adapted to individually and cooperatively engage and disengage a respective opposite edge of said pallet assembly in response to the timed sequence of a printing cycle said dual locator adapted to locate said pallet assembly to a predetermined position in relationship to said print screen when said printing machine is in the print portion of a printing cycle.

2. The apparatus of claim 1 wherein said pallet assembly comprises a support means and associated printing pallet, said support means adapted to receive and removably retain said pallet.

3. The apparatus of claim 2 wherein at least one of said dual locator means comprises a V-shaped notch located on the edge of said support means; and an associated roller assembly positioned by and rotatably attached to a roller support arm adapted to move said roller into and out of engagement with said V-shaped notch in response to the timed sequence of the printing cycle so as to locate said pallet assembly to a predetermined position in relationship to said print screen when said printing machine is in the print portion of the printing cycle.

4. The apparatus of claim 2 wherein each one of said dual locator means comprises a V-shaped notch located on the edge of said support means; and an associated roller assembly positioned by and rotatably attached to a roller support arm adapted to move said roller into and out of engagement with said V-shaped notch in response to the timed sequence of a printing cycle so as to locate said pallet assembly to a predetermined position in relationship to said print screen when said printing machine is in the print portion of a printing cycle.

5. The apparatus of claim 1 wherein one of said locator means engages and disengages its respective edge of said pallet assembly in response to the engagement and disengagement of the distal edge of said pallet assembly by said other locator means.

6. The apparatus of claim 5 wherein each one of said locator means are connected by a compressible connecting means.

7. A dual locator and pallet assembly for use in a printing machine having associated therewith a print head comprising: a resiliently mounted printing pallet assembly, said pallet assembly having at least one pair of opposite edges; dual locator means, each one of said dual locator means adapted to individually and cooperately engage and disengage a respective opposite edge of said pallet assembly in response to the timed sequence of a printing cycle, said dual locator adapted to locate said pallet assembly to a predetermined position in relationship to said print head when said printing machine is in the print portion of a printing cycle.

8. The apparatus of claim 7 wherein said pallet assembly comprises a support means and associated printing pallet, said support means adapted to receive and removably retain said pallet.

9. The apparatus of claim 8 wherein at least one of said dual locator means comprises a V-shaped notch located on the edge of said support means; and an associated roller assembly positioned by and rotatably attached to a roller support arm adapted to move said roller into and out of engagement with said V-shaped notch in response to the timed sequence of the printing cycle so as to locate said pallet assembly to a predetermined position in relationship to said print screen when said printing machine is in the print portion of a printing cycle.

10. The apparatus of claim 8 wherein each one of said dual locator means comprises a V-shaped notch located on the edge of said support means; and an associated roller assembly positioned by and rotatably attached to a roller support arm adapted to move said roller into and out of engagement with said V-shaped notch in response to the timed sequence of the printing cycle so as to locate said pallet assembly to a predetermined position in relationship to said print screen when said printing machine is in the print portion of a printing cycle.

11. The apparatus of claim 7 wherein one of said locator means engages and disengages its respective edge of said pallet assembly in response to the engagement and disengagement of the distal edge of said pallet assembly by said other locator means.

12. The apparatus of claim 11 wherein said locator means are connected by a compressible connecting means.

* * * * *